US006068306A

United States Patent [19]

Brautigam

[11] Patent Number: 6,068,306

[45] Date of Patent: May 30, 2000

[54] WINDOW LOCKING ARRANGEMENT

[76] Inventor: Richard H. Brautigam, 10 Georgian Cir., Newark, Del. 19711-2551

[21] Appl. No.: 09/184,670

[22] Filed: Nov. 2, 1998

[51] Int. Cl.[7] ..... E05C 3/14

[52] U.S. Cl. ..... 292/242; 292/DIG. 47; 292/DIG. 55

[58] Field of Search ..... 292/240–242, 292/346, DIG. 20, DIG. 47, DIG. 45, 228, 128, DIG. 55

[56] References Cited

U.S. PATENT DOCUMENTS

| | | | |
|---|---|---|---|
| 1,535,226 | 4/1925 | Jackson | 292/241 |
| 3,039,837 | 6/1962 | Poe | 292/204 |
| 3,599,452 | 8/1971 | Maryyama | 70/90 |
| 4,029,349 | 6/1977 | Sweda | 292/241 |
| 4,610,422 | 9/1986 | Billingsley | 292/54 |
| 5,454,609 | 10/1995 | Slocomb | 292/337 |

*Primary Examiner*—Flemming Saether
*Assistant Examiner*—Gary Estremsky
*Attorney, Agent, or Firm*—Connolly Bove Lodge & Hutz LLP

[57] ABSTRACT

A window locking arrangement includes a keeper having a locking tab and a lock having a cam member which is rotatably movable into contact with the locking tab. The inner surface of the cam member is flat at its locked location of contact with the keeper tab.

9 Claims, 1 Drawing Sheet

Fig.4 (PriorArt)

WINDOW LOCKING ARRANGEMENT

BACKGROUND OF THE INVENTION

Movable windows conventionally utilize various types of locking arrangements for selectively preventing and permitting a sash to move with respect to other sashes or parts of the window assembly. A known technique is to mount a keeper on one sash and a lock on the other sash. The keeper generally includes a spaced downwardly extending locking tab. The lock includes a rotatable cam which has an arcuate cam member having a first free end and a second end remote from the free end. The lock is mounted with respect to the keeper so that in the unlocked condition the cam member is completely within the lock housing thereby permitting free movement of the sash. In the locked condition, however, the cam is rotated so that its free end passes out of the housing and the inner surface or inner side wall of the free end passes behind the inner surface of the keeper locking tab. The rotational movement of the cam member continues until the inner side wall of the free end is sufficiently disposed against the keeper tab to prevent movement of the sash.

The above arrangement conventionally uses a cam member which has an arcuate inner surface for engaging the inner surface of the keeper tab. A disadvantage with such arrangement, however, is that for proper locking there must be precise alignment of the lock and keeper since any misalignment would not permit the proper engagement of the cam member and keeper tab.

SUMMARY OF THE INVENTION

An object of this invention is to provide a window locking arrangement of the above type which includes structure for accommodating some degree of misalignment between the lock and keeper.

A further object of this invention is to provide such a window locking arrangement which can be easily manipulated even with some degree of misalignment.

In accordance with this invention the inner side wall of the cam member includes a portion at a location between the free end and the remote end of the cam member which is of non-arcuate and preferably flat form at the location where the cam member is disposed against the locking tab.

In a preferred practice of the invention the flat shape of the inner side wall or inner surface of the cam member is located midway between the free end and remote end of the cam member.

THE DRAWINGS

FIG. 4 is an enlarged top plan view of a prior art lock; and

DETAILED DESCRIPTION

The present invention is directed to improvements in window locking arrangements which utilize a keeper and lock combination of the type well known in the prior art, but modified in accordance with this invention to tolerate misalignment of the keeper and lock. It is to be understood that the general details of the window structure with which the invention would be used is well known and need not be repeated herein except as would be desirable for an understanding of the invention.

Figure 2:
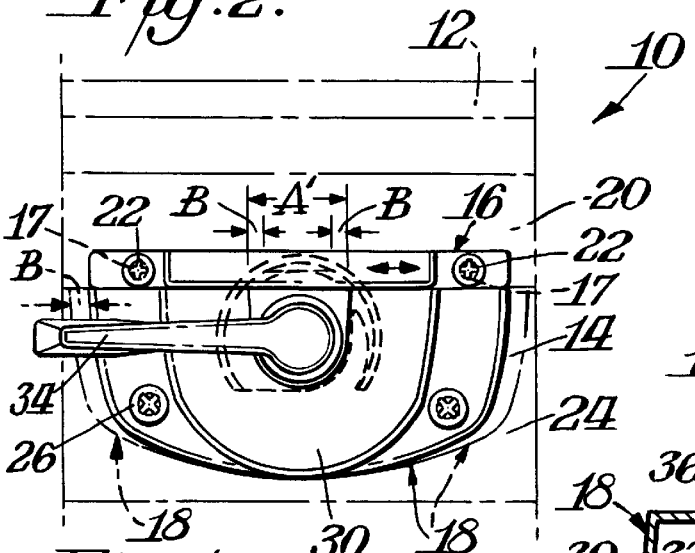
FIG. 2 is a top plan view of the arrangement shown in FIG. 1.
Figure 3:
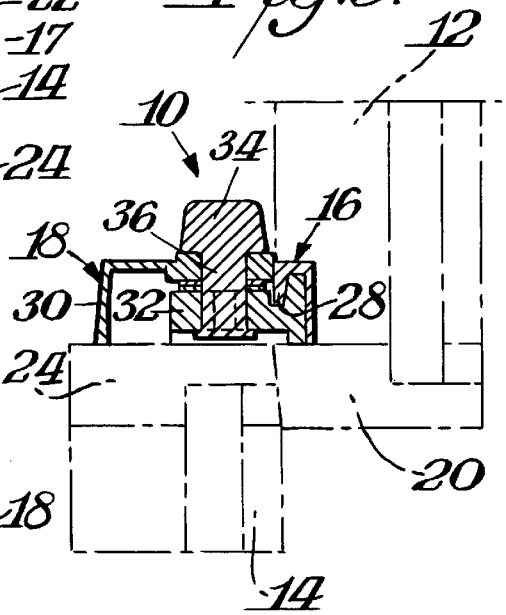
FIG. 3 is a cross-sectional view taken through FIG. 1 along the line 3—3.
Figure 1:
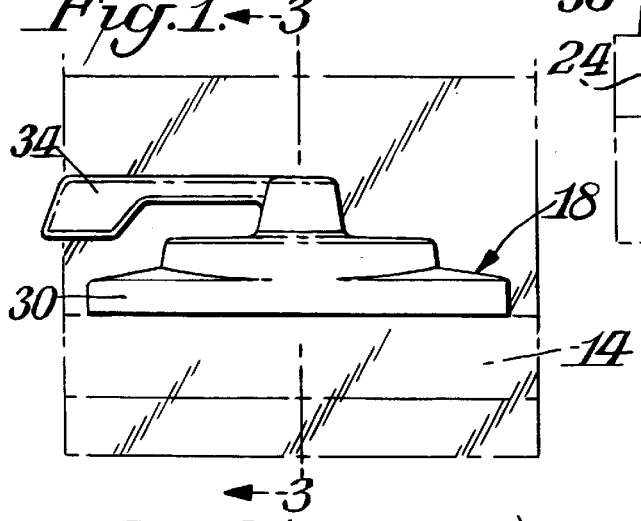
FIG. 1 is a front elevational view of a window locking arrangement in accordance with this invention.

FIGS. 1–3 illustrate a window locking arrangement 10 in accordance with this invention. As shown therein, and particularly in FIG. 3, the window locking arrangement 10 is illustrated as being used to selectively lock and unlock an upper sash 12 and a lower sash 14. The frame 20 of upper meeting rail or sash 12 has a keeper 16 secured thereto while the frame 24 of lower meeting rail or sash 14 has a lock 18 secured thereto. FIG. 2 illustrates keeper 16 to be mounted to frame 20 by means of suitable fasteners such as screws 22. Similarly, lock 18 is mounted to frame 24 by suitable fasteners such as screws 26. Other types of fastening, such as a snap lock assembly as disclosed in U.S. Pat. No. 5,454,609, may also be used.

Keeper 16 would be of generally conventional construction which includes a housing having an open end disposed toward lock 18. A downwardly extending locking tab 28 is mounted at the open end of the keeper housing. For this invention keeper 16 includes circular holes 17 (rather than conventional elongated slots) for screws 22, as shown in FIG. 2.

Lock 18 is also in a form which includes a housing 30 having an open end. A cam 32 is rotatably or pivotally mounted within housing 30 in a known manner such as by a hand lever 34 having its shaft 36 extend through housing 30 with the cam 32 mounted to shaft 36 for joint rotation.

Figure 5:
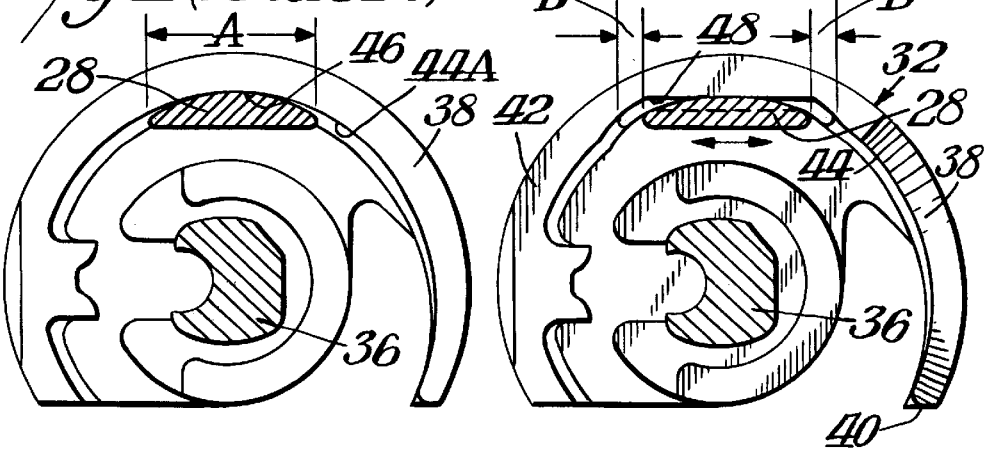
FIG. 5 is a view similar to FIG. 4 of the lock shown in FIGS. 1–3.

As best shown in FIG. 5 cam 32 includes an arcuate cam member 38 which has a first free end 40 and a second remote end 42.

FIGS. 1–3 and 5 illustrate the condition of cam 32 when in the locked condition. As shown therein the inner surface of inner side wall 44 is located so that it contacts the generally arcuate inner surface 46 of keeper locking tab 28. The free end 40 and remote end 42 are disposed within housing 30 to thereby prevent any relative movement of upper sash 12 and lower sash 14 with respect to each other.

In the unlocked condition lever 34 and cam 32 would be rotated counterclockwise 180° so that cam member 38 is entirely within housing 30 with no part of the cam member extending from housing 30 thereby permitting relative movement between upper sash 12 and lower sash 14. Alternatively cam 32 need only rotate 90° or 120° and still properly functions, as long as there is clearance to permit relative movement of sashes 12,14 and there is engagement of cam member 38 with locking tab 28 to alternatively prevent relative movement of the sashes. To again lock the sashes together, lever 34 would be rotated in the reverse or clockwise direction and free end 40 would extend from housing 30. Continued movement of lever 34 would cause free end 40 to pass behind locking tab 38 until the parts are in their locked condition which is illustrated in FIGS. 1–3 and 5.

FIG. 4 shows a prior art arrangement wherein the entire inner surface 44A of cam member 38 is arcuate along generally the same arc as the inner surface 46 of locking tab 28. With this conventional arrangement it is essential that there be precise alignment of the lock 18 and keeper 16 since any misalignment could not be tolerated and would result in a jam. The distance where the inner surface 44A contacts the inner surface 46 is indicated in FIG. 4 by the reference letter A.

FIGS. 2 and 5 best illustrate the improvement of the invention wherein a portion 48 of inner surface or inner side wall 44 is of non-arcuate and preferably flat shape at a distance generally midway between the ends 40,42 of cam member 38. The flat non-arcuate portion 48 extends over a distance A' and is located where the inner surface contacts inner wall 46 of tab 28. The distance A' is longer than the distance A by the distance B on each side of tab 28. This distance B corresponds to the degree of misalignment that could be tolerated if there were not a precise alignment of keeper 16 and lock 18 since it would still result in there being contact between inner surface 44 of cam member 38 and inner surface 48 of locking tab 28 over the distance A'. Distance B is, for example, ⅛ inch.

If desired the keeper may be modified to create a larger horizontal opening at its open end to accept the cam member 38 should there by any positioning off-center. The keeper tab, however, could remain the same. Because of the ability to accommodate misalignment, conventional elongated slots, are replaced by circular holes 17 to prevent the keeper 16 shifting sideways.

The invention may be practiced with the parts made of any suitable material such as metal, plastic, composite, etc. which is conventionally used in present lock/keeper arrangements.

What is claimed is:

1. In a window locking arrangement including a first movable sash selectively locked to a further sash by means of a lock which is selectively engaged with a keeper wherein the keeper has a spaced locking tab and wherein the lock has a rotatable cam member, said cam member being selectively rotatable about an axis to and from locking and unlocking positions, said cam member having a free end and a remote end, said cam member being of arcuate shape and having an inner side wall which is selectively mounted against said keeper locking tab in said locking position, the improvement being in that said inner side wall of said cam member is of arcuate shape at said free end for first engaging and then pulling in said keeper during rotation from an unlocked to a locked position, said arcuate shape of said free end merging into a flat portion disposed against said locking tab for positioning against said keeper in the locked position to maintain clearance between said sashes and compensate for misalignment between said keeper and said lock, and the distance between said locking tab and said axis of rotation of said cam member being generally the same in both said locking and unlocking positions.

2. The arrangement of claim 1 wherein said flat portion is generally midway between said free end and said remote end.

3. The arrangement of claim 1 wherein said flat location is longer than the length of said locking tab.

4. The arrangement of claim 1 wherein said keeper includes circular holes for mounting said keeper to the window frame.

5. In a window lock member for cooperating with a keeper to selectively lock two sashes together, said lock member comprising a housing having an open end, a shaft rotatably mounted to said housing, a cam mounted to said shaft whereby said cam is pivotally mounted to said housing, said housing including fastening structure to permit said housing to be fixedly non-movably mounted to a sash, said cam having an arcuate cam member with a free end and a remote end, said cam being selectively movable to an unlocking position and a locking position, said cam member being completely in said housing in said unlocking position, a portion of said cam member between said free end and said remote end extending outwardly of said housing in said locking position, and said cam member having an inner surface for being disposed against a keeper locking tab when said cam is in said locking position, the improvement being in that said inner surface of said free end is of arcuate shape for first engaging and then pulling in the keeper during rotation from an unlocked to a locked position, and said arcuate shape of said free end merging into a flat portion for positioning against the keeper in the locked position to maintain clearance between the sashes and compensate for misalignment between the keeper and said lock member.

6. The lock member of claim 5 wherein said flat portion is located generally midway between said free end and said remote end.

7. The lock member of claim 5 wherein said cam member is of generally rectangular cross section over the length of said flat portion.

8. The arrangement of claim 1 including a housing having an open end, a shaft rotatably mounted to said housing, said cam member being mounted to said shaft whereby said shaft comprises said axis of rotation, and said cam member being completely in said housing in said unlocking condition.

9. The arrangement of claim 1 wherein said cam member is of generally rectangular cross section over the length of said flat portion.

* * * * *